US005572959A

United States Patent [19]

Hedelin

[11] Patent Number: 5,572,959

[45] Date of Patent: Nov. 12, 1996

[54] METHOD FOR CONTROLLING THE WORKING CYCLE IN AN INTERNAL COMBUSTION ENGINE AND AN ENGINE FOR PERFORMING SAID METHOD

[75] Inventor: Lars Hedelin, Djursholm, Sweden

[73] Assignee: Fanja Ltd., St. Helier, United Kingdom

[21] Appl. No.: 362,443

[22] Filed: Feb. 28, 1995

[30] Foreign Application Priority Data

Jun. 30, 1992 [SE] Sweden ..... 9202019

[51] Int. Cl.[6] ..... F01L 1/34; F02B 75/04

[52] U.S. Cl. ..... 123/48 C; 123/564; 123/90.15; 418/159

[58] Field of Search ..... 123/48 B, 48 C, 123/564, 90.15, 90.17, 90.27; 418/159

[56] References Cited

U.S. PATENT DOCUMENTS

| | | | |
|---|---|---|---|
| 1,787,717 | 1/1931 | Boulet | 123/90.17 |
| 1,885,796 | 11/1932 | Boulet | 123/90.17 |
| 2,357,031 | 8/1944 | Stabler | 123/48 B |
| 2,991,930 | 7/1961 | Lindner | 418/159 |
| 3,633,552 | 1/1972 | Huber | 123/48 B |
| 3,797,975 | 3/1974 | Keller | 418/159 |
| 4,463,712 | 8/1984 | Stojek et al. | 123/90.17 |
| 4,469,055 | 9/1984 | Caswell | 92/82 |
| 4,508,089 | 4/1985 | Baumgartner et al. | 418/159 |
| 4,535,733 | 8/1985 | Honda | 123/90.17 |
| 4,685,429 | 8/1987 | Oyaiza | 123/90.15 |
| 4,736,715 | 4/1988 | Larsen | 123/318 |
| 4,860,702 | 8/1989 | Doundoulakis | 123/78 F |
| 4,998,511 | 3/1991 | van Avermaete | 123/48 B |
| 5,052,350 | 10/1991 | King | 123/90.27 |
| 5,178,105 | 1/1993 | Norris | 123/90.15 |
| 5,394,841 | 3/1995 | Murakami | 123/90.15 |

FOREIGN PATENT DOCUMENTS

| | | | |
|---|---|---|---|
| 0426540 | 5/1991 | European Pat. Off. | 123/48 B |
| 0560701 | 9/1993 | European Pat. Off. | 123/48 B |
| 813503 | 6/1937 | France . | |
| 413309 | 6/1918 | Germany . | |
| 424047 | 1/1926 | Germany . | |
| 3127760 | 3/1983 | Germany | 123/48 B |
| 3542629 | 6/1987 | Germany | 123/48 B |
| 3644721 | 7/1988 | Germany . | |
| 3725448 | 2/1989 | Germany . | |
| 13152 | 6/1907 | United Kingdom | 123/48 B |
| 2180597 | 4/1987 | United Kingdom . | |
| 92/09799 | 6/1992 | WIPO | 123/48 B |

*Primary Examiner*—David A. Okonsky
*Attorney, Agent, or Firm*—Young & Thompson

[57] ABSTRACT

In-line engine with variable compression, comprising a cylinder receiving section which is tiltably mounted in the crankcase section (4) of the engine, in which the crankshaft is mounted by means of crankshaft bearings (90) arranged in the lower region of the crankcase section (4). The crankshaft bearings incorporate bearing caps (102) which constitute continuous stiffening transverse connecting elements between the lower lateral parts (104,106) of the crankcase section. These transversely connecting bearing caps rest at their outer end (108,110) against internal surface areas in the lower lateral parts (104,106) of the crankcase section on both sides of the engine. The bearing caps are securing in the crankcase section (4) not only by means of vertical crankshaft bearing screws (112,114) but also by means of screwed joints (166, 118, 120) which connect the lower lateral parts to the outer ends (108, 110) of the bearing caps.

23 Claims, 7 Drawing Sheets

METHOD FOR CONTROLLING THE WORKING CYCLE IN AN INTERNAL COMBUSTION ENGINE AND AN ENGINE FOR PERFORMING SAID METHOD

The invention relates to a process for controlling the operating cycle of an internal combustion engine in accordance with the preamble to claim 1, and an internal combustion piston engine for carrying out said process in accordance with the preamble of claim 11.

Internal combustion piston engines of four-stroke type are today the predominant type of power unit for motor vehicles, especially passenger cars. Most internal combustion piston engines are subjected to widely varying conditions of load and rpm. For passenger car engines, the conditions vary greatly between congested city traffic and highway driving involving rapid acceleration and high speeds with a fully loaded automobile on uphill grades. In order to fulfill acceleration and top speed requirements, the automobile engine must be excessively overdimensioned in respect to power requirements for normal driving.

In commonly available modern automobile piston engines, diagrams showing efficiency as a function of torque and rpm reveal that the maximum efficiency for the engine is achieved at significantly higher torques and rpm:s than those occurring during normal driving. During the major portion of the time the engine is running, the efficiency is significantly lower than its maximum. In addition to higher fuel consumption, this means greater emission of harmful exhaust.

The purpose of the present invention is to provide a process and an internal combustion piston engine which makes possible smaller engine dimensions and driving close to the efficiency maximum during the greater portion of the torque and optimum range with improved vehicle acceleration and top speed at the same time as less fuel is consumed and a significant reduction in the emission of harmful exhaust is achieved. This is achieved by a process which is characterized by the features disclosed in the characterizing clause of claim 1, and with an engine which is characterized by the features disclosed in the characterizing clause of claim 11.

Advantageous embodiments of the process and the engine according to the invention are disclosed in the dependent claims which are subordinated to claim 1 or claim 11.

The invention will be described in more detail below with reference to the accompanying drawings, which in partially schematic form show different embodiments of an engine according to the invention for carrying out the process according to the invention.

Figure 1:
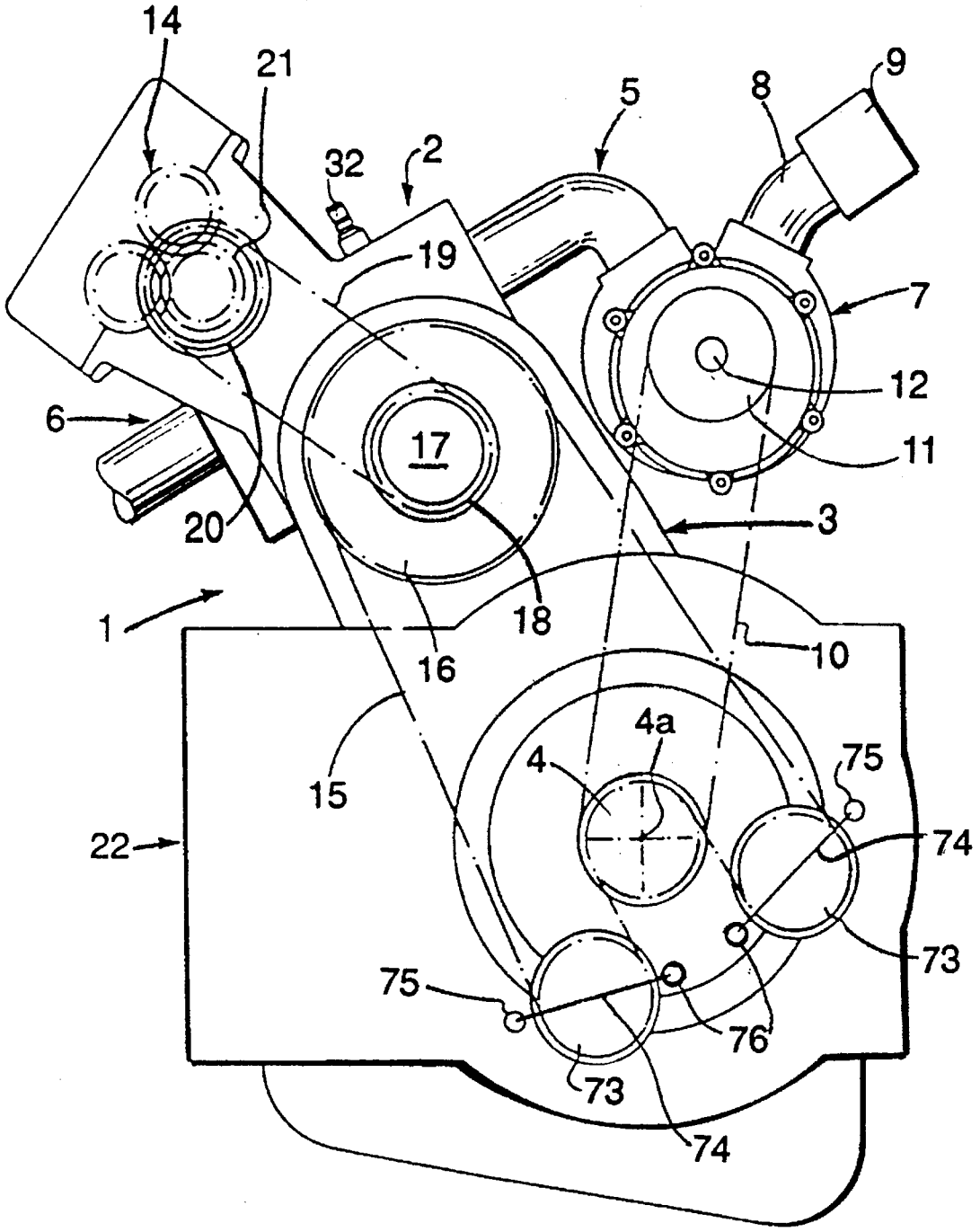
Figure 2:
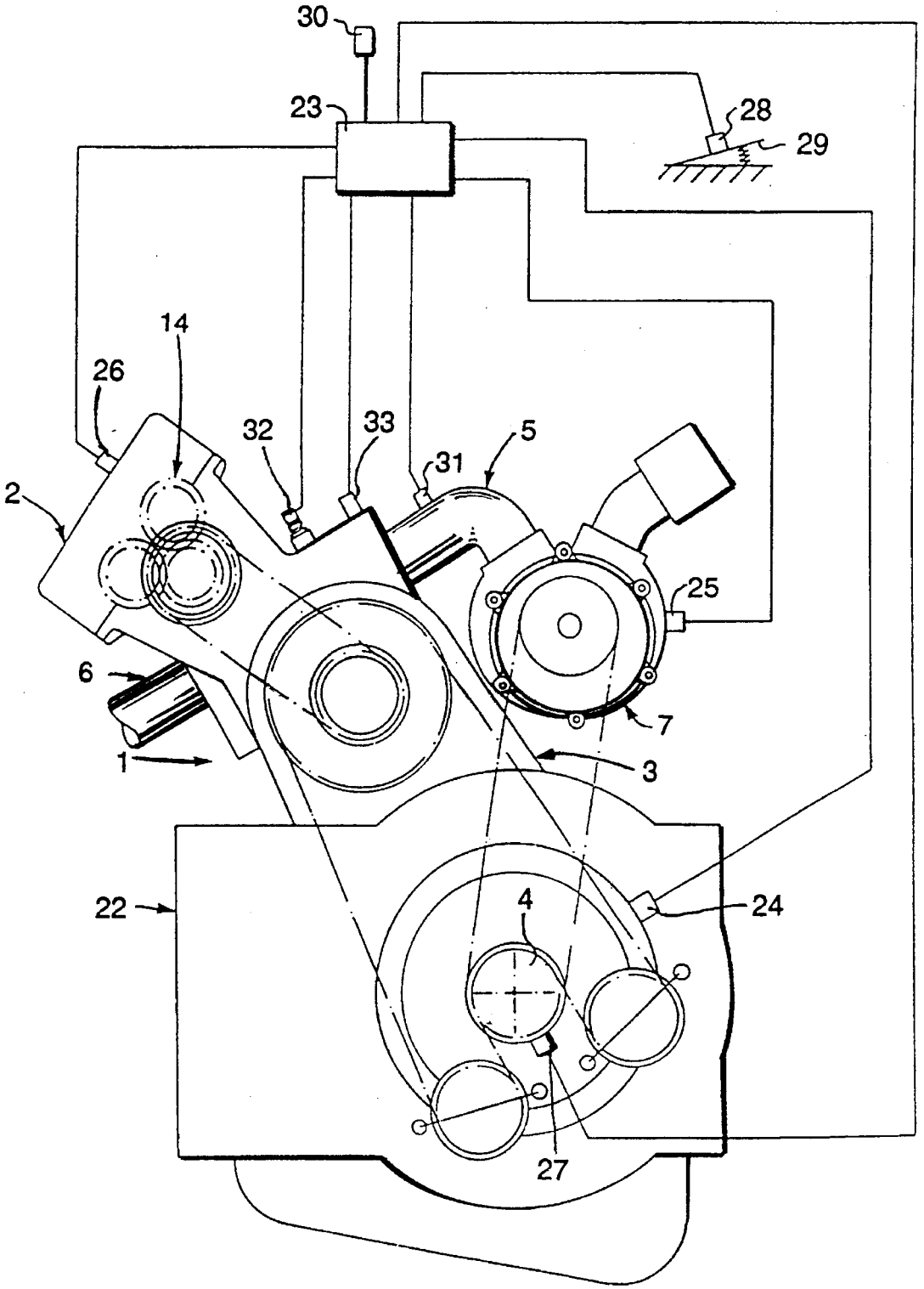
Figure 4:
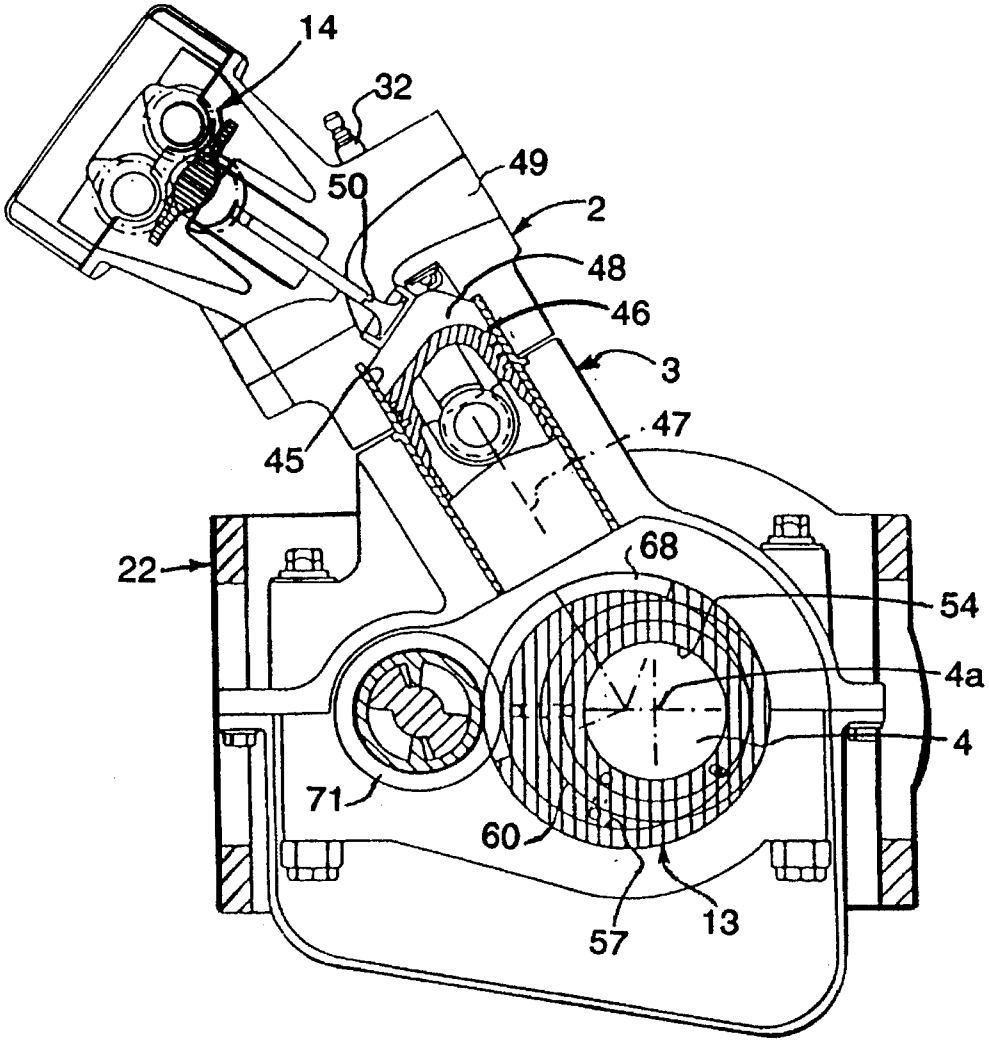
Figure 3:
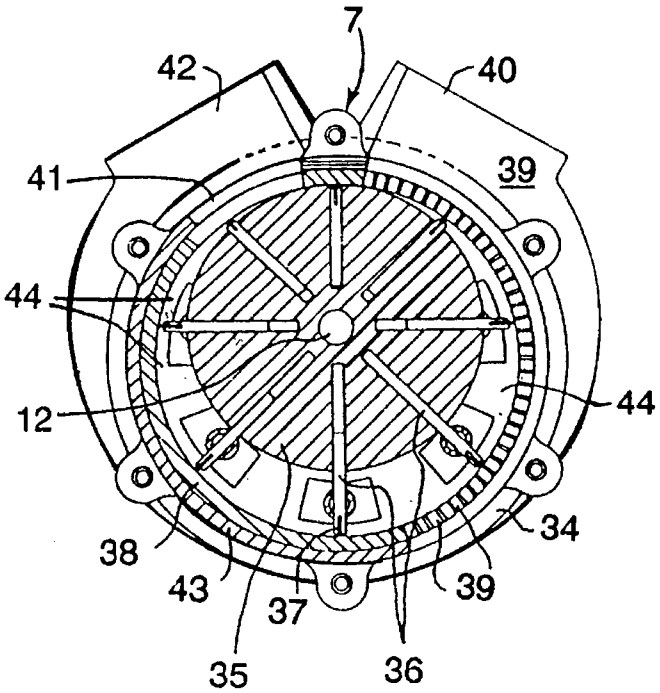
Figure 6:
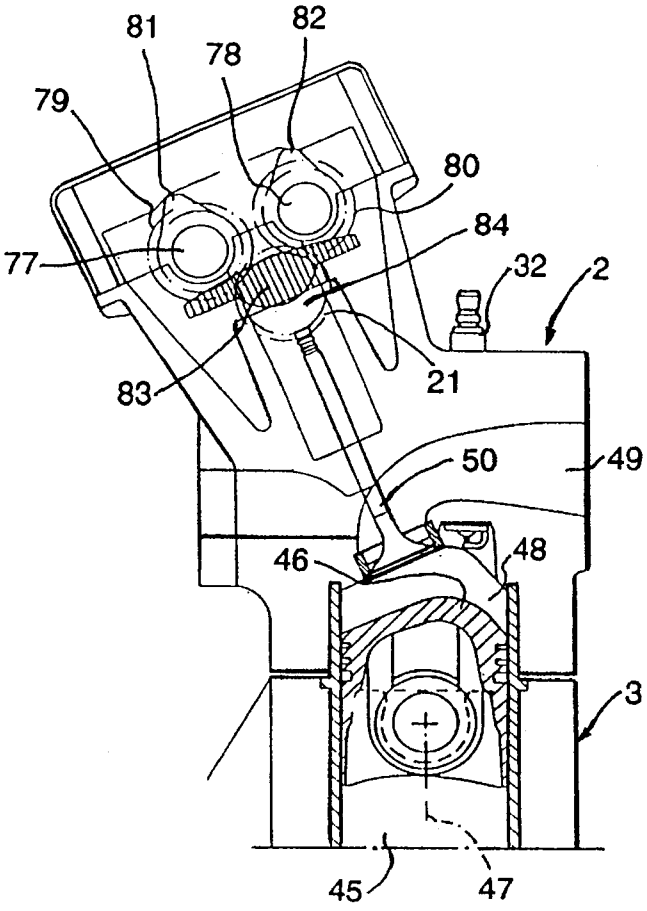
Figure 5:
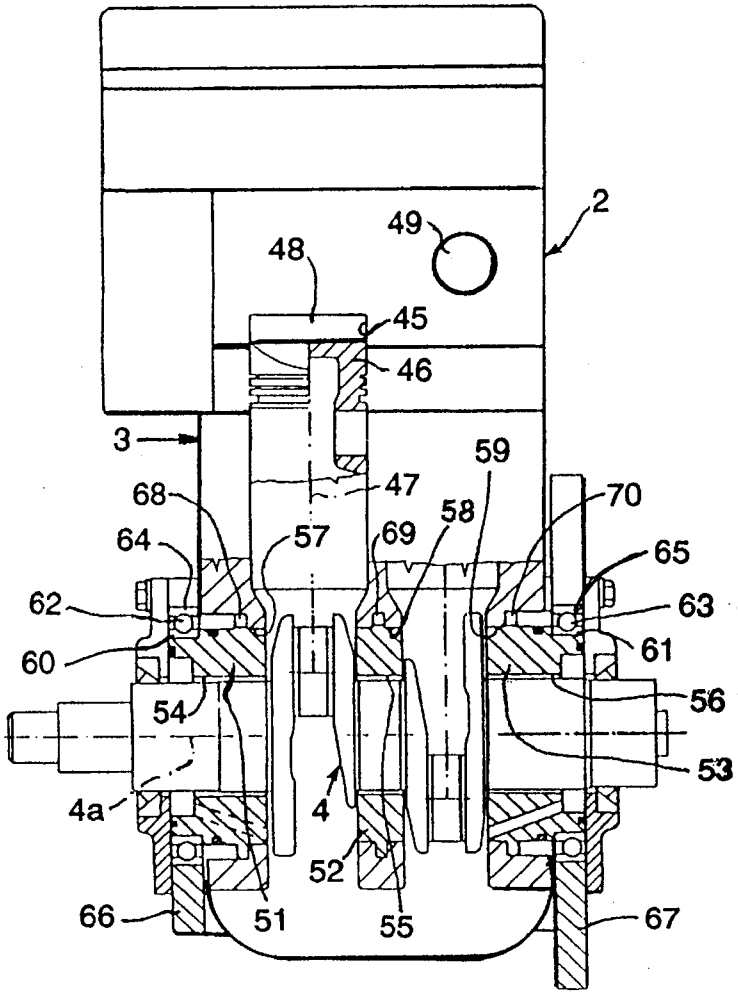
Figure 7:
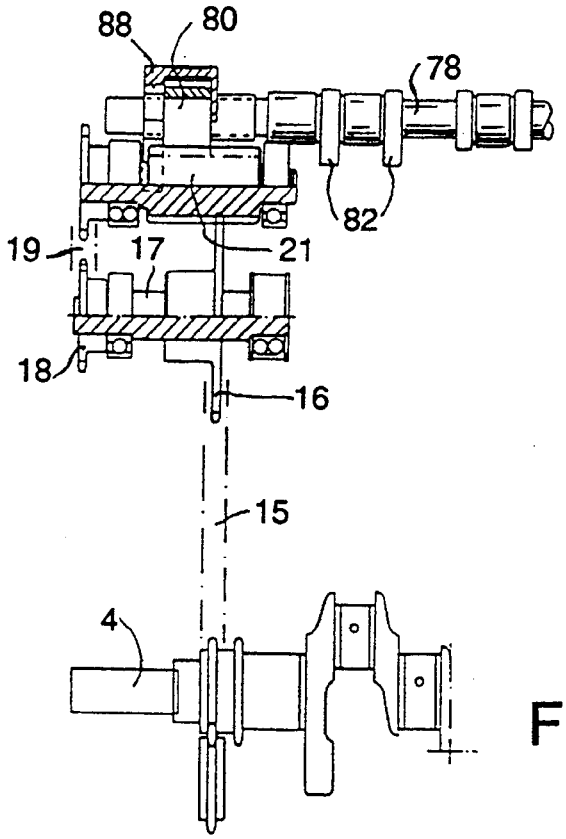
Figure 8:
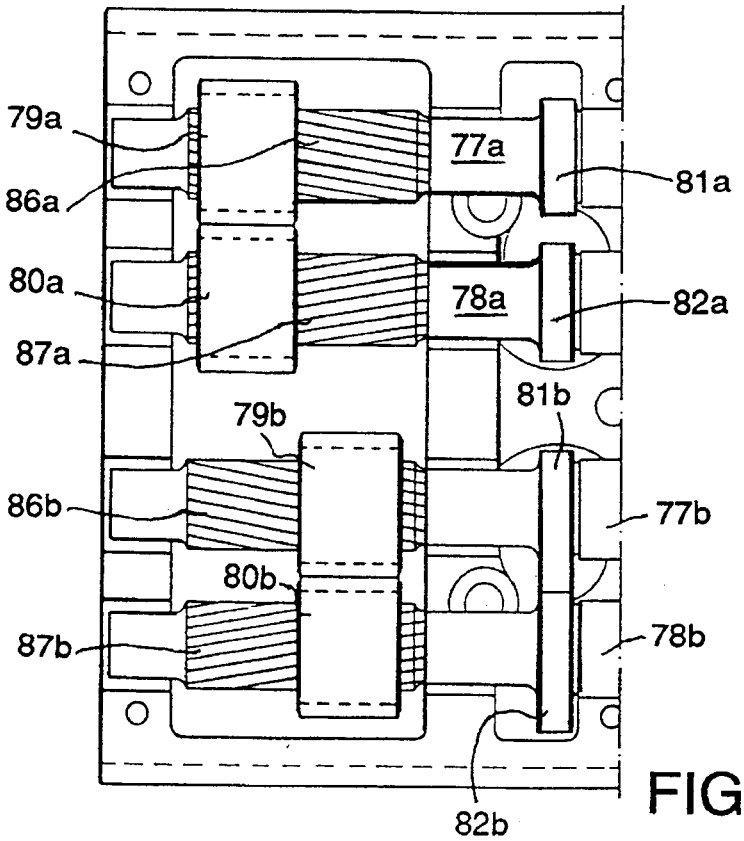
Figure 10:
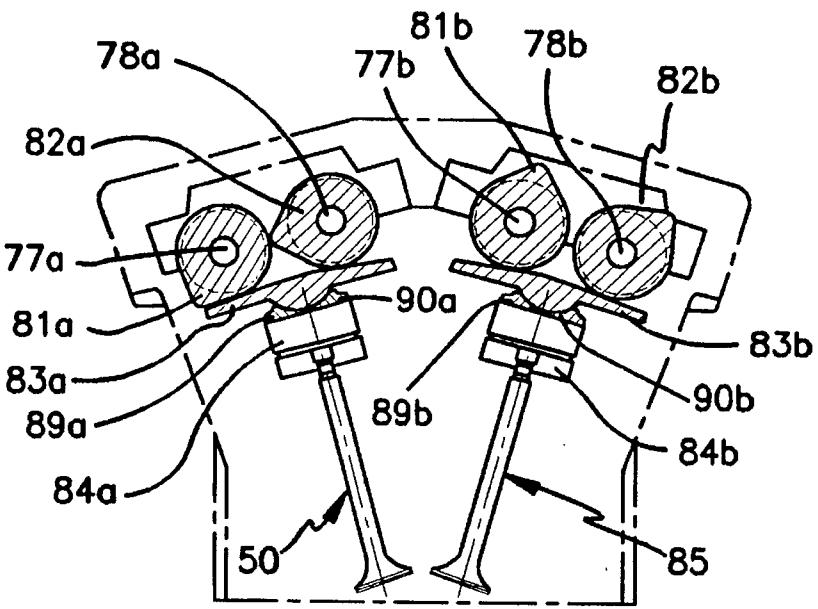
Figure 9:
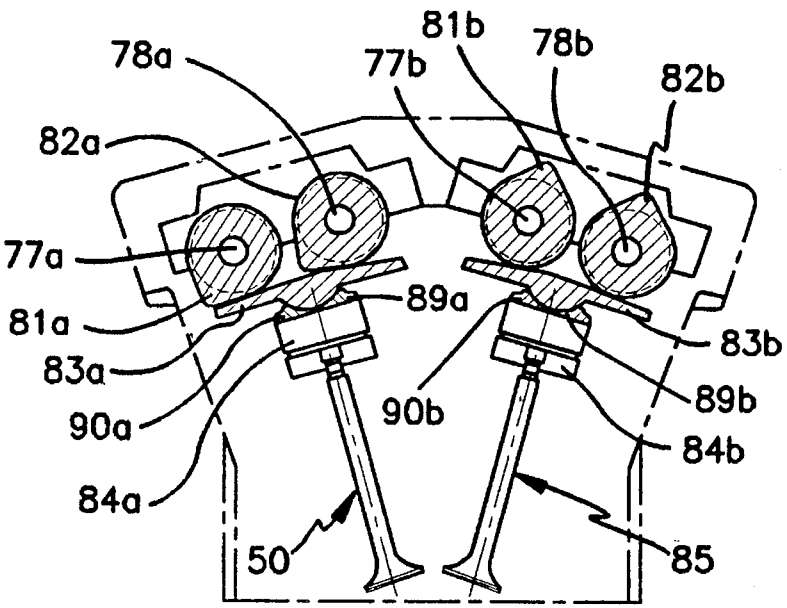
Figure 11:
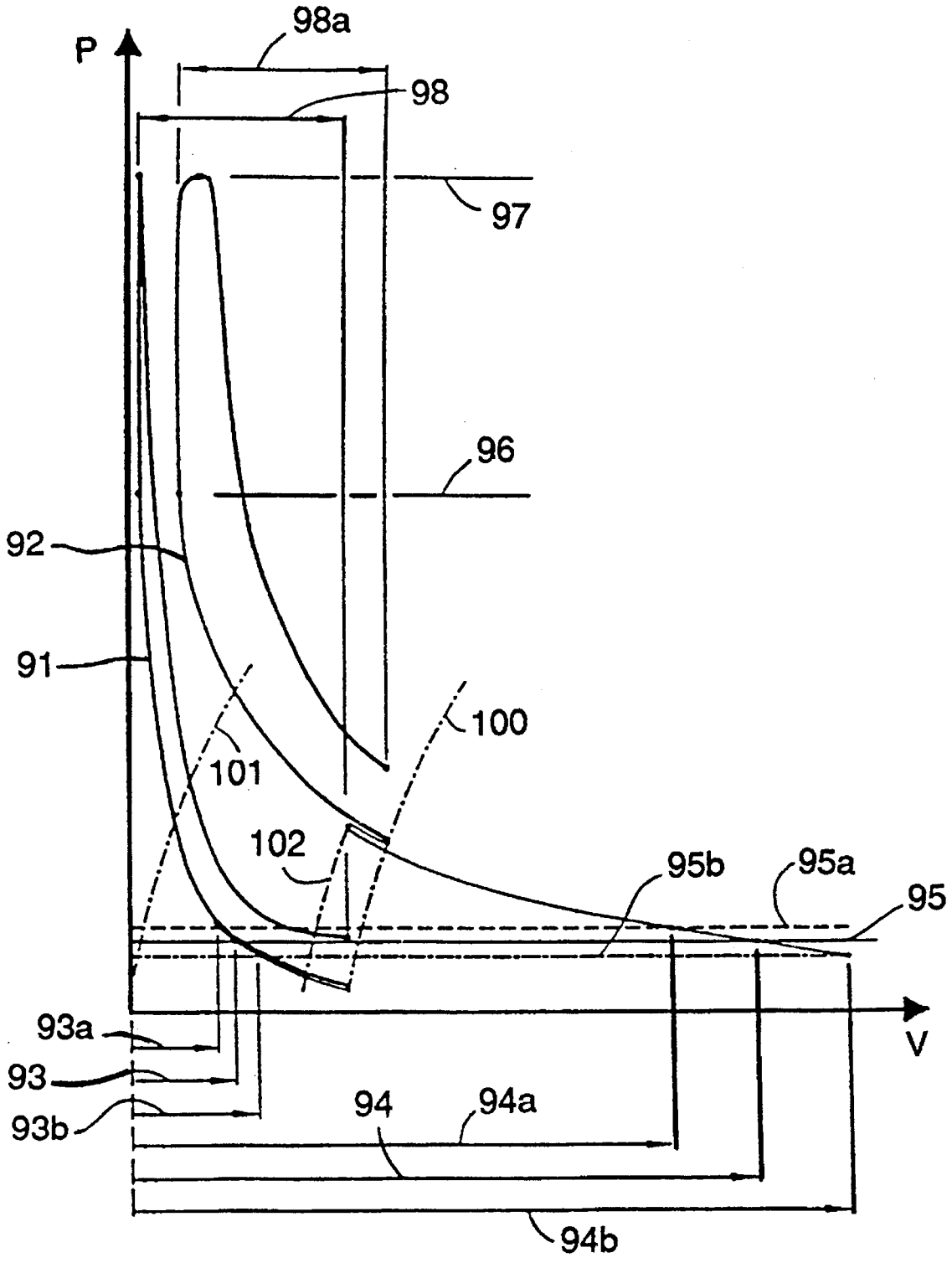

FIG. 1 is a schematic end view of an internal combustion piston engine according to one embodiment of the invention, FIG. 2 is a schematic view of the engine according to FIG. 1 with associated control system, FIG. 3 shows a Cross-section through an air charger for the engine according to FIGS. 1 and 2, FIG. 4 shows a schematic section through the engine according to FIG. 1, perpendicular to the rotational axis of the crankshaft, FIG. 5 shows a schematic longitudinal section through the engine according to FIG. 1, essentially through the longitudinal axes of the cylinders, FIG. 6 shows a schematic section through a portion of the engine according to FIG. 1, FIG. 7 is a partially cut-away side view of a drive device for the cam mechanism in the engine according to FIG. 1, FIG. 8 is a view from above, partially cut-away and with certain components removed, of a portion of a cam mechanism according to the invention, FIGS. 9 and 10 are schematic side views of parts of the valve mechanism in an engine according to FIG. 1, FIG. 11 is a pressure-volume diagram (PV-diagram) which shows the operating cycle of the engine according to FIG. 1.

FIG. 1 shows schematically an internal combustion piston engine 1 with a cylinder head 2 and an engine block 3. The engine block 3 carries a crankshaft 4, mounted in the manner which is described in more detail below.

The engine 1 has one or more cylinders, but the number of cylinders is essentially irrelevant to the invention, and therefore no specific number will be disclosed.

The engine 1 is provided with an intake system 5 and an exhaust system 6, which are only shown partially here. Both the intake system 5 and the exhaust system 6 are of course each connected to the cylinders of the engine 1.

The engine intake system 5 includes an air charger 7 for feeding air into the engine 1. The air charger 7 takes in air through an intake opening 8, which is provided with an air filter 9. The air charger 7 usually takes in surrounding atmosphere air, but it is also conceivable to provide the air charger 7 with air of another temperature or of another pressure. In this context, it should also be noted that the air charger 7 does not need to be provided with air of normal composition; rather, it is also conceivable to provide the air charger 7 with a gas or gas mixture of another composition, possibly mixed with fuel. For the sake of simplicity, however, in this discription the term "air" will be used and this term is considered to encompass the above-described variations as well.

The air charger 7 is driven by a drive means 10, which is shown with dash dot lines in FIG. 1 and is in turn driven by the crankshaft 4. The drive means 10 drives a drive wheel 11 which is fixed to a shaft 12 in the air charger 7. The drive means 10 can consist of any known drive means, for example a chain, a toothed belt or the like. Alternatively, take power transmission between the crankshaft 4 and the shaft 12 in the air charger 7 can consist of a gear transmission or any other type of power transmission, which provides, as does the means shown, a fixed transmission ratio between the crankshaft 4 and the shaft 12.

The engine 1 also comprises a displacement device 13, which makes it possible to change the distance between the rotational axis **4*a* of the crankshaft 4 and the cylinder head 2. By changing this distance, the compression ratio of the engine 1** is changed, and this will be described in more detail below.

The engine 1 is also provided in the cylinder head 2 with a valve mechanism 14 which is indicated schematically in FIG. 1 and will be described in more detail below. The valve mechanism 14 is driven, in the embodiment shown in FIG. 1, by the crankshaft 4, which drives a drive means 15 in the form of a chain or the like. The chain 15 drives a sprocket 16 on an intermediate shaft 17. The intermediate shaft 17 also carries a secondary sprocket 18, which drives a secondary chain 19, which in turn drives a sprocket 20, which is joined to a transmission gear 21 in the valve mechanism 14.

The engine 1 also has a frame 22, which surrounds the engine block 3 and supports the entire engine 1 in a manner which will be described in more detail below. The frame 22 is intended to be solidly mounted in a vehicle, for example, and a clutch or gear box can be fixed to the frame 22 in the known manner.

FIG. 2 shows the engine according to FIG. 1 in a smaller scale, and also shows a control system for controlling the operating cycle of the engine 1. This control system is shown very schematically. The control system comprises a control unit 23, to which a number of sensors are connected for feeding values of various parameters to the control unit 23, and a number of regulating means, which receive signals from the control unit 23 to regulate the various functions of the engine. Thus, there are regulating means 24 for adjusting the compression ratio of the engine and providing signals to the control unit 23 corresponding to the current value of the compression ratio. Furthermore, there is a regulating means 25 for adjusting the amount of air provided by the air charger and for providing signals to the control unit 23 corresponding to the current stage of the regulating means 25. In a similar manner, there is a regulating means 26 for setting the valve mechanism 14 and for sending signals to the control unit 23 as to the current setting of the regulating means 26. Furthermore, there is a sensor 27 for providing signals concerning the current rpm of the engine, a sensor 28 for providing signals concerning the current position of a gas pedal 29 or other accelerator in the vehicle, in which the engine 1 is mounted. Furthermore, there is a sensor 30 for providing signals corresponding to pressure and/or temperature of the ambient air and a sensor 31 for providing signals corresponding to pressure and/or flow speed in the intake system 5. Finally, the control unit 23 is also coupled to an ignition system for the engine, indicated schematically in FIG. 2 by a spark plug 32, and a fuel supply unit 33 for supplying fuel to the engine 1. The function of these regulating means and sensors will be described in more detail below.

FIG. 3 shows the charging unit 7 in section. The shaft 12 is mounted in a housing 34 and carries a circular cylindrical rotor 35, which is provided with a plurality of radial slots for vanes 36, displaceable radially in the slots. At the radially outer end of each vane 36, there is a sealing means 37 which is designed to provide a seal between each vane 36 and the housing 34.

In the housing 34, there is a fixed cylindrical wall 38, against the interior side of which the sealing means 37 acts. The cylindrical wall 38 is provided with perforations 39 over a portion of its surface. Outside the perforations 39, the housing 34 is provided with an intake duct 40, to which the intake conduit 8 is connected. The perforations 39 allow air into the interior of the housing 15, and the cylinder wall 38 is also provided with an outlet opening 41 which leads to an outlet duct 42 in the housing 34. The outlet duct 42 is in turn connected to the intake system 5.

Outside the cylindrical wall 38, there is an exterior,. semicylindrical shell 43, which can be controllably moved along the exterior of the cylindrical wall 38. The movement of the shell 43 is controlled by the regulating means 25, which can consist of, for example, a drive gear in engagement with teeth on the exterior of the shell (not shown in FIG. 3). The movement of the shell 43 will to a greater or lesser extent expose the perforations 39 to allow air from the intake duct 40 to enter the interior of the housing 34. When the shaft 12 is driven by means of the drive device 4, 10, 11, the rotor 35 will rotate and the vanes 36 will move with the sealing means 37 in contact with the interior surface of the cylindrical wall 38. The vanes 36 seal, on one hand, against the interior surface of the cylindrical wall 38, and, on the other hand, against the end walls of the housing 34, thus defining separate air chambers 44, in each of which a predetermined amount of air is transported from the intake duct 40 to the outlet duct 42. During this journey, the air enclosed in an air chamber 44 is subjected to changes in its state, varying in response to the position of the shell 43.

FIG. 3 shows the shell 43 in a position, where the perforations 39 are exposed and opened to the inlet duct 40. This means that the air chamber 44 will not be closed off before the rear vane 36 in the rotational direction has passed all of the perforations 39. The volume in the air chamber 44 is at that point at its maximum, and continued rotation of the rotor 35 compresses the air until the air chamber 44 opens to the outlet 41 and the outlet duct 42.

If the shell 43 is rotated from the position shown in FIG. 3 to a position where most of the perforations 39 are covered by the shell, air from the intake duct 40 will flow into an air chamber 44, the volume of which is relatively small since it is enclosed when the rear wing 36 of the rotor 35 in the rotational direction passes the edge of the shell 43. As the rotor 35 continues to rotate, the air enclosed in the air chamber 44 will first expand with concomitant drop in temperature and then be subjected to a certain amount of recompression to the suitable volume before the air in the air chamber 44 is fed into the outlet duct 42 through the outlet opening 41.

By adjusting the position of the shell 43, it is thus possible to select the amount of air which is enclosed in each air chamber 44 and which is delivered to the outlet opening 41 and the outlet duct 42. Depending on the position of the shell 43, the enclosed air in each air chamber 44 is subjected to a change in state which can adapt the pressure and temperature of the air to the requirements of the engine 1. The positioning of the shell 43 is accomplished with the aid of the regulator means 25.

Concerning the details of the construction of the air charger 7 and other embodiments of the same, reference is hereby made to the co-pending patent application with the title "Process and device for charging an internal combustion engine with air".

As stated above, the engine 1 also comprises a displacement device 13, which makes it possible to adjust the engine compression ratio. The displacement device 13 is best shown in FIGS. 4 and 5. These Figures show one of the engine cylinders 45, in which a piston 46 is disposed for reciprocal movement. The piston 46 is connected by means of a piston rod 47 (shown as a heavy dash dot line in FIGS. 4 and 5) to the crankshaft 4. In the cylinder head 2, there is a combustion chamber 48 as well as inlet and outlet ducts for gas exchange therein. Of these ducts, there is shown in FIGS. 4 and 5 an inlet duct 49, the communication of which with the combustion chamber 48 is controlled by means of a valve 50, which is in turn controlled by means of the valve mechanism 14 in a manner which will be described in more detail below.

The crankshaft 4 is mounted for rotation in crankshaft bearings in the engine block 3. Each crankshaft bearing comprises an adjustment disc 51, 52 or 53, as can be seen in FIG. 5. Each of the adjustment discs 51, 52, and 53 is provided with a bearing opening 54, 55 or 56, respectively, and the crankshaft 4 is mounted for rotation in these bearing openings. The bearing openings 54, 55 and 56 are excentrically disposed in the adjustment discs 51, 52 and 53, and are in turn mounted for rotation in the bearing openings 57, 58 and 59, respectively, in the engine block 3.

The adjustment discs 51 and 53 located at the ends of the engine are also equipped with bearing races 60 and 61, respectively, which are arranged concentrically with the rotational axis 4*a* of the crankshaft 4. In the races 60 and 61, respectively, there are bearings 62 and 63, respectively, which bearings are fitted into bearing apertures 64 and 65, respectively, in the end plates 66 and 67, respectively, of the frame 22, which thereby, via the adjustment discs 51 and 53, carries the entire engine.

When the adjustment discs 51, 52, and 53, are turned by means of a mechanism which will be described in more detail below, the engine block 3 and the cylinder head 2 will be displaced relative to the frame 22. In order for this displacement to be effected in the desired manner, the upper portion of the engine block 3 is guided relative to the frame by means of guide means (not shown).

The adjustment discs 51, 52 and 53 are provided with toothed segments 68, 69 and 70, respectively, which are concentric with the bearing openings 57, 58 and 59, respectively, in the engine block 3. The toothed segments 68, 69 and 70 are in engagement with gears, one of which is shown at 71 in FIG. 4, and a hollow regulator shaft 72, which is mounted for rotation in the engine block 3. The regulator shaft 72 is made as a part of a hydraulic rotational cylinder and constitutes a portion of the regulating means 24 which was described above with reference to FIG. 2.

As the adjustment ;discs 51, 52 and 53 are rotated by means of the gears 71 on the regulator shaft 72, the axis 4*a* of the crankshaft 4 will be displaced relative to the engine block 3 and the cylinder head 2. In the embodiment shown, this is done by the engine block 3 and the cylinder head 2 being displaced relative to the crankshaft 4, while the rotational axis 4*a* of the crankshaft 4 is fixed relative to the frame 22. When the adjustment discs 51, 52 and 53 are turned, the rotational axis 4*a* is displaced relative to the surface-of the cylinder head 2 which lies adjacent the combustion chamber 48 in the cylinder 45. This means that the upper end position of the piston 46 is changed, which in turn changes the volume of the combustion chamber 48 when the piston 46 is in its upper end position. The compression ratio of the engine 1 is thus changed.

In order to be able to carry out the relative displacement between the cylinder head 2 and the crankshaft 4, there is also required a device to keep the drive means 15 for driving the valve mechanism 14 tight. Such a device is shown Schematically in FIG. 1 and comprises a compensation pulley 73 on each side of the crankshaft 4. In this manner, the drive means 15 runs over the compensator pulleys 73, which are each mounted in the middle of an individual arm 74. One end of each arm 74 is pivoted at a point 75 which is fixed relative to the crankshaft 4, while the other point of each arm 74 is pivoted to a point 76 which is moveable together with the engine block 3 and the cylinder head 2. In this manner, the drive means 15 is held taut regardless of the position of the rotational axis 4*a* of the crankshaft 4, and this is done without any change in the relative rotational positions between the crankshaft 4 and the intermediate shaft 17.

A more detailed description of the displacement device 13 and the associated components for changing the compression ratio is given in the co-pending patent application with the title "Process and device for changing the compression ratio in an internal combustion engine".

In the discussion of FIG. 1, the valve mechanism 14 was mentioned. This is shown in more detail in FIGS. 6–10. The valve mechanism 14 is driven, as was stated above, by a power transmission arrangement, which is driven by the engine crankshaft 4. As was described above, this power transmission arrangement drives a transmission gear 21, which in turn drives two cam shafts 77 and 78, respectively, with the aid of two drive gears 79 and 80, respectively, which are only indicated schematically in FIG. 6.

To actuate the valve 50, the cam shafts 77 and 78 are each provided with an invididual cam means 81 and 82, respectively, and these cam means act on an intermediate means 83, which in turn acts on a valve opener 84, which directly affects the valve 50.

FIGS. 8–10 show a valve mechanism which differs from the valve mechanism 14 shown in the other Figures by virtue of the fact that the valves 50 in each cylinder are arranged at an angle to each other. This design is primarily intended for an engine with four valves per cylinder, but the same general design can also be used in an engine with two valves per cylinder. As can be seen in FIGS. 8–10, there are, firstly, cam shafts 77*a* and 78*a* which correspond to the cam shafts 77 and 78 in FIG. 1, and, secondly, cam shafts 77*b* and 78*b* for the valves 85 set at an angle to the first valves 50 (see FIGS. 9 and 10).

As can be seen in FIG. 8, the drive gears 79*a*, 80*a* are arranged on splined portions 86*a* and 87*a*, respectively, on the cam shafts 77*a* and 78*a*, respectively. The splines on the spline portions 86*a* and 87*a* are arranged at a relatively small predetermined pitch angle relative to the longitudinal axis of the respective cam shaft 77*a*, 78*a*. The splines in the embodiment shown in FIG. 8 have different pitch orientations, but, alternatively, the splines can have the same orientation. The lead angles are chosen to provide the desired pattern of movement of the valve 50, as will be described in more detail below.

The drive gears 79*a*, 80*a* are in engagement with the transmission gear 21, which, as can be seen in FIG. 7, has a length which corresponds to the length of the splined portions 86*a*, 87*a*. By displacing the drive gears 79*a*, 80*a* along the splined portions 86*a*, 87*a*, it is possible to alter the relative rotational positions of the cam shafts 77*a*, 78*a*.

The discussion above concerning the cam shafts 77*a*, 78*a* also complies, in a corresponding manner, to the cam shafts 77*b*, 78*b*.

To displace the drive gears 79, 80 along the associated splined portions 86, 87, there is a yoke 88 (see FIG. 7), which embraces the drive gears 79, 80 and at the same time permits them to rotate. The yoke 88 can be displaced forwards and backwards by means of the regulating means 26 (not shown in FIGS. 7–10), which can be a hydraulic or automatic actuator or other mechanical adjustment means of suitable type. The two end positions for the drive gears 79, 80 are shown in FIG. 8, one end position being shown at the upper portion of the Figure, while the other end position is shown at the lower portion.

FIGS. 9 and 10 show a valve mechanism according to the invention in various positions. FIG. 9 shows the valve 50 at the moment when it starts to open, with the cam shafts 77*a*, 78*a* in the relative rotational position which they assume when the drive gears 79*a*, 80*a* are in the axial position on the splined portions 76*a*, 78*a* which is shown at the top of FIG. 18. FIG. 10 shows the valve 50 at the instant when it starts to open, the cam shafts 77*a*, 78*a* being at the relative rotational position which they assume when the drive gears 79*a*, 80*a* are in the position on the spline portions 86*a*, 87*a* which is shown at the bottom of FIG. 8.

It is also evident from FIGS. 9 and 10 that the intermediate means 83*a*, 83*b* each consists of a plate, which on its side facing the valve opener 84*a*, 84*b* is provided with a projection 89*a*, 89*b*. The projection 89*a*, 89*b* is semicylindrical and fits into a corresponding cavity 90*a*, 90*b* in the valve opener 84*a*, 84*b*. The axis of the semicylindrical projections 89*a*, 89*b* of the intermediate means 83*a*, 83*b* and of the semicylindrical cavities 90*a*, 90*b* of the valve openers 84*a*, 84*b* extend essentially parallel to the longitudinal axis of the 77*a*, 78*a* and 77*b*, 77*b*, respectively. This means that the intermediate means 83*a*, 83*b* will function as two-armed levels and can swing about their connection with the valve openers 84*a*, 84*b* in planes which are perpendicular to the longitudinal axis of the cam shafts 77*a*, 78*a*, 77*b*, 78*b*.

As can be seen in FIGS. 9 and 10, the cam means 81*a*, 82*a* on the cam shafts 77*a*, 78*a* each interact with an individual arm on the intermediate means 83*a*. It is suitable that the centre of the semicylindrical projection 89*a* on the intermediate means 83*a* be located at or in the vicinity of the surface of the intermediate means 83*a* which interacts with the cam means 81*a*, 82*a*.

This of course also applies to the valve 85 and associated components.

With this construction of the valve mechanism 14, it is possible to change the pattern of movement of the valves 50 and 85 depending on the operating conditions of the engine 1. FIG. 9 shows, for example, that the valve 50 or 85, respectively, is opened rapidly, i.e. with high acceleration. The open time of each valve 50 and 85 is in this case relatively short, due to the fact that the two cam means 81*a*, 82*a* and 81*b*, 82*b*, respectively, work in parallel, i.e. their rotational positions are identical. This means that the intermediate means 83*a*, 83*b* will not move pivotally relative to the valve opener 84*a*, 84*b* but function as a rigid intermediate means. FIG. 10 shows, however, the cam shafts 77*a*, 78*a* and 77*b*, 78*b*, respectively, in another relative rotational position. The cam means 81*a* on the Cam shaft 77*a* is just beginning to act on the intermediate means 83*a*, while the cam means 82*a* on the cam shaft 78*a* still does not affect the intermediate means 83*a*. Continued rotation from the position shown in FIG. 10 will therefore mean that the cam means 81*a* will press down the arm of the intermediate means 83*a*. Thus, the intermediate means 83*a* will pivot relative to the valve opener 84*a* until the cam means 82*a* on the cam shaft 78*a* begins to act on its arm of the intermediate means 83*a*. This will mean that the opening movement will take a relatively long time, which means that the acceleration of the valve 50 will be relatively low. The total open time of the valve 50 will thus be relatively long.

A more detailed description of the valve mechanism 14 is provided in the co-pending patent application with the title "Process and device for actuating a valve".

In the engine according to the invention described above, it is possible to control the operating cycle in accordance with the method according to the invention. A basic factor in this case is that it is possible with the aid of the air intake unit 7 to directly control the amount of air which is supplied to each of the engine cylinders 45. As was disclosed above, this is done by rotating the shell 43 to close off a greater or lesser portion of the openings 39, so that each air chamber 44 will have a predetermined volume when closed off by means of the approching vane 36. The air thus enclosed is then subjected to compression before it is expelled through the outlet openings 41 and the outlet duct 42 which leads to the engine intake system 5.

Control of the position of the shell 43 is done with the aid of the regulator means 25, which is controlled by the control unit 23. The position of the shell 43 is thus determined as a function of the engine rpm, which is sensed by the sensor 27, the position of the accelerator pedal 29, which is sensed by the sensor 28, and the state of the air in the intake system 5, which is sensed by the sensor 31. Furthermore, the position of the shell 43 is dependent on the state of the ambient air, which is sensed by the sensor 30. The signals from all of the sensors and regulator means are processed by the control unit 23, which then sends a signal to the regulator means 25 to set the shell 43.

At the same time, the control unit 23 uses the information from the sensors and regulator means to compute a setting for the regulator means 24, which, as was described above, provides a setting for the displacement device 13, so that the adjustment discs 51, 52 and 53 are turned to a specific angular position. A specific compression ratio is thereby set for each cylinder 45 by the setting of the upper end position of the piston 46. This means of course that the compression volume, i.e. the volume in the combustion chamber 48 when the piston 46 is in its upper end position, will have a specific value. The compression ratio is thereby determined by means of the control unit 23 relative to the air flow into the intake system 5 by the air intake unit 7, so that the current air requirement of the engine is precisely fulfilled. This means that in each combustion chamber 48 in the engine at the end of the compression stroke, one strives to obtain the same pressure and temperature regardless of the rpm and load conditions of the engine. It is thus possible to achieve the best possible conditions for combustion of the fuel, which is fed through the fuel supply device 33 which is controlled by the control unit 23. The amount of fuel is regulated, of course, in relation to the amount of air in the combustion chamber 48.

FIG. 11 shows a PV-diagram for an engine according to the invention. The curve 91 represents operation at a high engine compression ratio, while the curve 92 represents operation at a 10w compression ratio. The curve 91 represents work with a small amount of air which is supplied by means of the air charging unit 7, while the curve 92 represents work with a large amount of air supply. This is shown by the arrows 93 and 94, respectively, which indicate the volume of the amount of air prior to compression in the air charging unit 7. The line 95 represents normal atmospheric pressure. The dashed line 95*a* represents higher air pressure and the dash-dot line 95*b* represents lower air pressure. The air charging unit 7 changes the amount of air fed into the engine to that indicated by the arrows 93*a*, 94*a*, and 93*b*, 94*b*, respectively. In the diagram, the line 96 indicates the pressure achieved in the combustion chamber 48 at the end of the compression stroke, while the line 97 indicates the combustion pressure. The arrows 98 and 98*a*, respectively, indicate the swept volume, i.e. the volume which the piston 48 displaces during one stroke. This volume is of course also independent of the prevailing compression ratio in the engine.

FIG. 11 also shows a curve 100 representing the lower end position of the piston 46, and a curve 101 representing the upper end position of the piston 46. FIG. 11 also shows a curve 102 representing the conditions in the intake duct 49 of the engine. The distance between the curves 102 and 100 is a measure of the volumetric efficiency of the engine. If the volumetric efficiency were 100%, the curves 102 and 100 would coincide.

Turning the adjustment discs 51, 52 and 53 displaces the rotational axis 4*a* of the crankshaft 4 not only parallel to the longitudinal axis of the cylinder 45 but also perpendicular thereto. The displacement is thus in two dimensions, and the angle of the piston rod 47 relative to the longitudinal axis of the cylinder 45 will be changed. This change can be used to improve engine performance. When the rotational axis 4*a* of the crankshaft 4 is displaced laterally relative to the longitudinal axis of the cylinder 4, this means that the piston 46, during the last portion of the compression stroke, will move a longer distance for each degree of rotation of the crankshaft 4 than during the first portion of the subsequent power stroke. In this manner, better conditions are achieved for combustion in the combustion chamber 48, and thus an increase in the efficiency of the engine. By suitable dimensioning of the adjustment discs 51, 52 and 53 and suitable placement thereof, it is possible to achieve a lateral displacement of the rotational axis 4*a* of the crankshaft 4, which provides the desired pattern of movement of the piston 46 at different compression ratios.

With the aid of the regulator means 26, it is possible, as was indicated above, to alter the opening and closing times for the valves 50 and 85. This can be utilized at low engine rpm, so that the control unit 23 moves the yoke 88 and thus the drive gears 79 and 80 to obtain rapid opening and closing of the valves 50 and 85, respectively, and this improves the flow conditions through the valves and thus the gas exchange in the combustion chamber 48. At high rpm, however, the regulator means Can displace the yoke 88 and thus the drive gears 79 and 80, so that the opening and closing of the valves 50 and 85, respectively, is effected more slowly, thereby avoiding overloading the components in the valve mechanism 14.

The control unit 23 can also forcibly limit the opening and closing times of the valves 50 and 85, when the engine 1 is operating at a very high compression ratio. In this case, the compression volume, i.e. the volume of the combustion chamber 48 at the upper end position of the piston 46 will be very small. This means that the piston 46 will be very close to the valves 50 and 85, and therefore these must be closed when the piston 46 is at its upper end position close to said valves. The socalled overlap, i.e. the time during which both the intake valve and the exhaust valve are completely or partially open at the end of the exhaust stroke must be severely limited or eliminated.

I claim:

1. Process for controlling the operating cycle of an internal combustion piston engine (1), said engine having one or more cylinders (45), each with a reciprocating piston (46), an intake system (5) for supplying air to each of the cylinders (45), and exhaust system (6) for removing combustion products from each of the cylinders (45), and valves (50, 85) in each of the cylinders for regulating the passage between each cylinder (45) and the intake system (5) and between each cylinder and the exhaust system (6), said process comprising regulation of the amount of air supplied to the engine (1) dependent on the engine air requirement by means of a charging unit (7) in the intake system (5), characterized in that for each Operating cycle in each of the engine cylinders (45), a specific amount of air is delimited by means of the charging unit (7) and is fed in the delimited state into the engine intake system (5), that the size of this specific amount of air is regulated depending on the current engine air requirement, and that the compression ratio in the engine is regulated in relation to the size of the specific amount of air, so that the condition of the amount of air in the combustion chamber (48) of the cylinder (45) at the end of the compression stroke is essentially uniform regardless of the engine load conditions.

2. Process according to claim 1, characterized in that the specific amount of air in the charging unit (7) is subjected to a change of state so that when charged into the intake system (5) it has a state which essentially corresponds to the state of the previously charged air in the intake system (5).

3. Process according to claim 1, characterized in that the size of the specific amount of air is regulated by changing the volume of each amount of air when delimiting the same.

4. Process according to claim 1, characterized in that the compression ratio in the engine (1) is regulated by changing the relative distance between the rotational axis (4*a*) of the engine crankshaft (4) and the surface of the engine cylinder head (2), which constitutes the limit at the end of each cylinder (45).

5. Process according to claim 4, characterized in that the relative displacement between the rotational axis (4*a*) of the crankshaft (4) and the cylinder head (2) is effected in such a manner that the rotational axis of the crankshaft is displaced both parallel to the plane containing the longitudinal axis of each of the engine cylinders (45) and perpendicular to said plane.

6. Process according to claim 4, characterized in that the relative displacement is achieved by displacing the rotational axis (4*a*) of the crankshaft (4) along a circular arc as seen relative to the cylinder head ( 2 ).

7. Process according to claim 1, characterized in that the actual values of the operating parameters for the engine (1) are sent by means of sensor means (24–28, 30, 31), which send actual value signals to a control unit (23), that the control unit (23) according to a predetermined program computes desired values for the air supplied to the engine and for the compression ratio as well as sending regulator signals for regulating these parameters with the aid of associated regulating devices (24, 25).

8. Process according to claim 7, characterized in that the control unit also computes desired values for opening and closing times for the valves (50, 85) as well as sending regulator signals to a regulating device (26) for regulating the opening and closing times of the valves (50, 85).

9. Process according to claim 7, characterized in that the control unit (23) also computes desired values for supplying fuel to the engine (1) and sends regulator Signals to a fuel supply device (33) for regulating the fuel supply to the engine.

10. Process according to claim 7, characterized in that the control unit (23) also computes desired values for the point in time for igniting the fuel air mixture in the engine cylinders (45) and sends regulator signals to an ignition device (32) for regulating the point in time for ignition.

11. Internal combustion piston engine (1), said engine having one or more cylinders (45), an intake system (5) with a charging device (7) for supplying air to each of the cylinders, an exhaust system (6) for removing combustion products from each of the cylinders, and valves (50,85) in each of the cylinders (45) for regulating the communication between each cylinder and the intake system (5) as well as between each cylinder and the exhaust system (6), characterized in that the charging device (7) is provided with at least one air chamber (44) for feeding a specific delimited amount of air from an intake duct (40) to an exit duct (42), a driving device (4, 10, 11) which is coupled to the engine (1) to be driven thereby in a predetermined relationship to the rotation of the engine crankshaft (4), and regulator means (25, 43) for regulating the volume of each air chamber (44) when delimiting the specific amount of air, and that there is a device (13) for changing the relative distance between the rotational axis (4*a*) of the engine crankshaft (4) and the surface of the engine cylinder head (2), which constitutes the limit at the end of each of the cylinders (45) in the engine (1);

wherein the charging device (7) is of vane compressor type with a cylindrical rotor (35), essentially disposed in a cylindrical housing (34), said rotor having essentially radially disposed vanes (36), delimiting between them air chambers (44), and the communication of each air chamber with the intake duct (40) is arranged to be cut off by means of the regulator means (25, 43) at a predetermined adjustable position; and wherein the intake duct (40) is arranged radially outside the vanes (36) in the housing (34), and that the communication between the intake duct (40) and the interior of the housing (34) consists of a plurality of openings (39) in a cylinder wall (38), against the interior surface of which the vanes (36) are in sealing contact, said regulator means comprising a shell (43), which is arranged radially outside the cylindrical wall (38) and is displaceable peripherally along said wall to cover a greater or lesser part of the portion of the cylindrical wall (38) provided with the openings (39).

12. Engine according to claim 11, characterized in that the outlet duct (42) is arranged radially outside the vanes (36) in the housing (34), and that the communication between the interior of the housing (34) and the outlet duct (42) consists of an outlet opening (41) in the cylindrical wall (38).

13. Engine according to claim 11, characterized in that the shell (43) is arranged to be set by means of a drive means, which is arranged in the housing (34).

14. Internal combustion piston engine (1), said engine having one or more cylinders (45), an intake system (5) with a charging device (7) for supplying air to each of the cylinders, an exhaust system (6) for removing combustion products from each of the cylinders, and valves (50, 85) in each of the cylinders (45) for regulating the communication between each cylinder and the intake system (5) as well as between each cylinder and the exhaust system (6), characterized in that the charging device (7) is provided with at least one air chamber (44) for feeding a specific delimited amount of air from an intake duct (40) to an exit duct (42), a driving device (4, 10, 11) which is coupled to the engine (1) to be driven thereby in a predetermined relationship to the rotation of the engine crankshaft (4), and regulator means (25, 43) for regulating the volume of each air chamber (44) when delimiting the specific amount of air, and that there is a device (13) for changing the relative distance between the rotational axis (4*a*) of the engine crankshaft (4) and the surface of the engine cylinder head (2), which constitutes the limit at the end of each of the cylinders (45) in the engine (1);

wherein the crankshaft (4) is mounted for rotation in eccentrically placed bearing openings (54–56) in circular adjustment discs (51–53) , which are rotatably mounted in bearing openings (57–59) in the engine block (3), and that a rotating device (61–72) is coupled to the adjustment discs (51–53) for simultaneous rotation thereof relative to the engine block (3).

15. Engine according to claim 14, characterized in that an adjustment disc (51, 53) is arranged at each end of the crankshaft (4), each of said adjustment discs having a bearing race (60, 61) concentric with the bearing opening (54, 56), by means of which the adjustment disc (51, 53) is rotatably mounted in a frame (22), and that the engine block (3), by means of at least one control means, is joined to the frame (22) for control displacement relative thereto when the adjustment discs (51–53) are rotated by means of the rotation device (68–72), which is fixed relative to the engine block (3).

16. Engine according to claim 14, characterized in that the rotation device consists of a hydraulic rotational cylinder (72) with gears or tooth segments (71), which are in engagement with a tooth segment (68–70) on each of the adjustment discs (51-53).

17. Engine according to claim 14, said crank-shaft (4) being arranged in a known manner to drive a valve mechanism ( 14 ) in the cylinder head ( 2 ) by means of at least one drive means (15), characterized in that the drive means (15) runs over two compensator pulleys (73), which are arranged for displacement corresponding to the displacement of the rotational axis (4*a*) of the crankshaft (4) relative to the engine block (3) without mutual rotation between the crankshaft (4) and the valve mechanism (14).

18. Engine according to claim 17, characterized in that the valve mechanism (14) for each valve (50, 85) comprises a cam mechanism driven by the drive means (15) to actuate a valve opener (84), which is arranged to operate the valve (50, 85), said cam mechanism comprising, firstly, two essentially parallel, rotatable cam shafts (77, 78) with individual cam means (81, 82) for actuating the valve opening (84) by means of a common intermediate means (83), and, secondly, a mechanism (79, 80, 86–88) for changing the relative rotational position of the cam shafts (77, 78).

19. Engine according to claim 18, characterized in that the intermediate means (83) consists of a two-armed lever, which is Joined to the valve opener (84) for pivotal movement in one plane which is essentially perpendicular to the longitudinal axis of the cam shafts (77, 78), and that the cam means (81, 82) on the, cam shafts (77, 78) are disposed to cooperate with an individual arm of the lever.

20. Engine according to claim 19, characterized in that the connection between the intermediate means (83) and the valve opener (84) consists of a semicylindrical projection (89) on the intermediate means (83) and a complementary, semicylindrical cavity (90) in the valve opener (84), the centre of the projection (89) and the cavity (90) preferably essentially coinciding with the surface of the intermediate means (83) with which the cam means (81, 82) interacts.

21. Engine according to claim 18, characterized in that the mechanism for changing the relative rotational position of the cam shafts (77, 78) comprises a drive gear (79, 80) on each of the cam shafts, said drive gears being displaceably disposed on splined drive portions (86, 87) on the cam shafts, said splines on the drive portions (86, 87) being arranged with a predetermined angle of pitch relative to the longitudinal axis of the cam shafts (77, 78).

22. Engine according to claim 21, characterized in that he drive gears (79, 80) can be displaced in the longitudinal direction of the cam shafts (77, 78) by means of a yoke (88), which embraces the drive gears (79, 80) and is driven by a regulator means (26).

23. Engine according to claim 21, characterized in that the splines on the drive portion (86) on one of the cam shafts (77) has an opposite pitch orientation to the splines on the drive portion (87) of the other cam shaft (78).

* * * * *

UNITED STATES PATENT AND TRADEMARK OFFICE

CERTIFICATE OF CORRECTION

PATENT NO. : 5,572,959

DATED : November 12, 1996

INVENTOR(S) : Lars HEDELIN

It is certified that error appears in the above-indentified patent and that said Letters Patent is hereby corrected as shown below:

On the title page, change "[22] Filed: February 28, 1995" to the following:

[22] PCT Filed: June 30, 1993

[86] PCT No.: PCT/SE93/00598

§ 371 Date: February 28, 1995

§ 102(e) Date: February 28, 1995

[87] PCT Pub. No.: WO 94/00679

PCT Pub. Date: January 6, 1994.

Signed and Sealed this

Fourteenth Day of January, 1997

*Attest:*

*Attesting Officer*

BRUCE LEHMAN

*Commissioner of Patents and Trademarks*